United States Patent [19]

Smidt

[11] Patent Number: 4,627,830

[45] Date of Patent: Dec. 9, 1986

[54] BOX-ERECTING MACHINE

[76] Inventor: Joseph J. Smidt, Const. Huygenslaan 51, 2332 TS Leiden, Netherlands

[21] Appl. No.: 724,591

[22] Filed: Apr. 18, 1985

[30] Foreign Application Priority Data

Apr. 18, 1984 [NL] Netherlands ..... 8401256

[51] Int. Cl.[4] ..... B31B 1/80

[52] U.S. Cl. ..... 493/316; 493/313

[58] Field of Search ..... 493/316, 317, 313, 314

[56] References Cited

U.S. PATENT DOCUMENTS

| | | | |
|---|---|---|---|
| Re. 27,631 | 5/1973 | Berney | 493/313 |
| 3,613,525 | 10/1971 | Lense . | |
| 3,695,151 | 10/1972 | Caron . | |
| 3,911,799 | 10/1975 | Klund | 493/313 |
| 4,285,679 | 8/1981 | Wahle . | |
| 4,437,851 | 3/1984 | Salenbo | 493/124 |
| 4,439,174 | 3/1984 | Derderian . | |

FOREIGN PATENT DOCUMENTS

| | | | |
|---|---|---|---|
| 1034470 | 7/1958 | Fed. Rep. of Germany . | |
| 2246769 | 3/1974 | Fed. Rep. of Germany | 493/313 |
| 975494 | 3/1951 | France . | |
| 7801945 | 2/1978 | Netherlands . | |
| 691627 | 5/1953 | United Kingdom . | |

*Primary Examiner*—Francis S. Husar
*Assistant Examiner*—William E. Terrell
*Attorney, Agent, or Firm*—Larson and Taylor

[57] ABSTRACT

A box-erecting machine is provided which comprises a frame (1) including an arrangement for receiving a stack of box blanks (17), and an arm (5) provided with suction cups (15) which can be pressed against the leading wall (16) of the forwardmost blank. The machine provides for moving the arm (5) in a horizontal direction and at right angles to the leading wall (16) of the blank (17), and for thereafter rotating the arm (5) with respect to the erected box, as well as for bringing the arm (5) back to its starting position. A roller (33) is provided at one end of a carrying arm (34), the other end of which is pivotably connected to a guide member (36) so to provide support for the box during erecting thereof.

3 Claims, 3 Drawing Figures

BOX-ERECTING MACHINE

Figure 2:
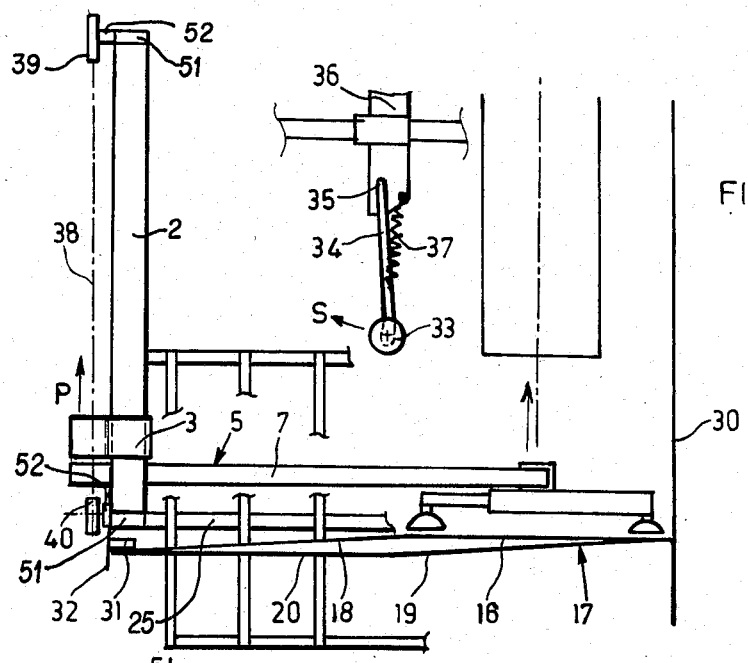

The invention relates to a box-erecting machine.

The boxes which are to be erected are present in such machines in the shape of blanks folded one time across their longitudinal direction, the edges of which are connected to each other.

With known machines of this type the arm which is provided with the suction cups is moved vertically upward after the erecting of a box, then is moved back across the box and is subsequently moved downward to come again to its starting position. Because of this a relatively cumbersome construction results.

Further during moving back the arm to its starting position a given mass of material has to be accelerated and decelerated. This will take a certain period of time during which the machine essentially is not productive.

Now the invention aims to improve the machine in this respect and to this and provides that the means for moving the arm in the horizontal direction is positioned near one side of the frame and is arranged such that the arm is rotatable in respect to this location so that the arm can be brought out of the track of an erected box.

To make, in an easy way, the machine suitable for erecting boxes of various dimensions according to a further feature of the invention, use is made of at least four suction cups, positioned in a rectangular pattern and such that the two lowest cups, in the starting position before they are pressed against the leading wall of a box, are always at the same height but are adjustable over a mutually equal distance to a vertical line which coincides with the center line of the leading wall of a box which has to be erected, the other two suction cups being adjustable at a varying height above the first mentioned two suction cups.

With this arrangement, the leading wall of a box which has to be erected can be connected to the arm as closely as possible near the corners of the box. By this it is guaranteed that the side walls of the box are folded at the right place in respect of the leading wall.

To have the folding of that side wall of the box, which in the starting position of the blank is lying in the same plane as the leading wall, executed as well as possible, according to the invention use is made of a roller, provided at the one end of a carrying arm which is rotatable in a horizontal plane and directed at right angles to the leading wall, the other end of which is rotatably connected to a guide member for the corresponding side wall of the box which can be fixed to the frame at a desired place, such that this side wall can cause rotation of the carrying arm against the working of a spring when erecting a box, the arm moving back again to its starting position after the box has passed.

Figure 1:
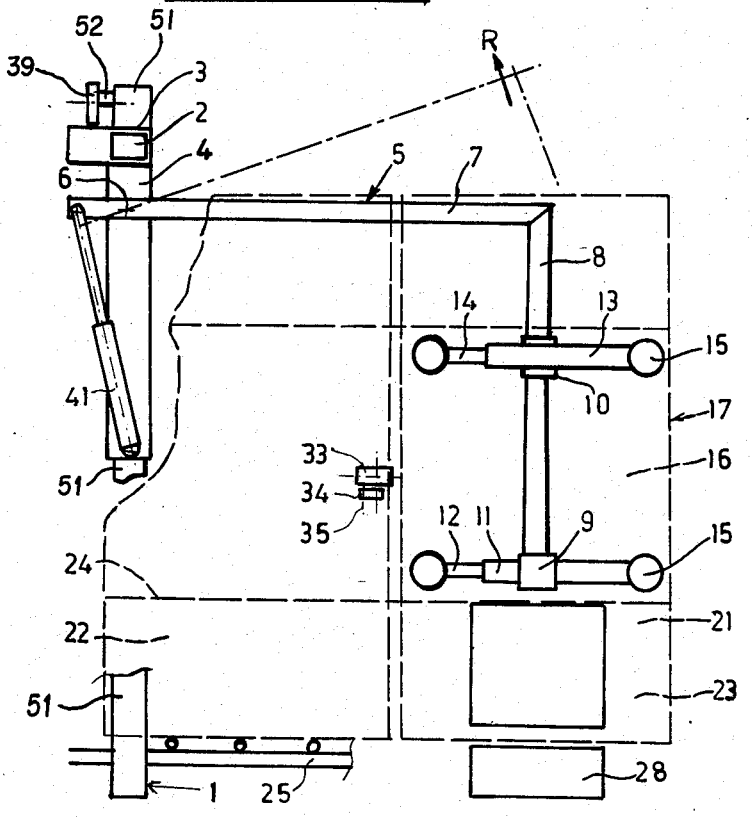
Figure 3:
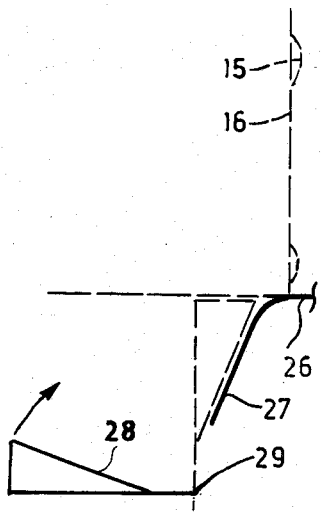
Figure 2A:
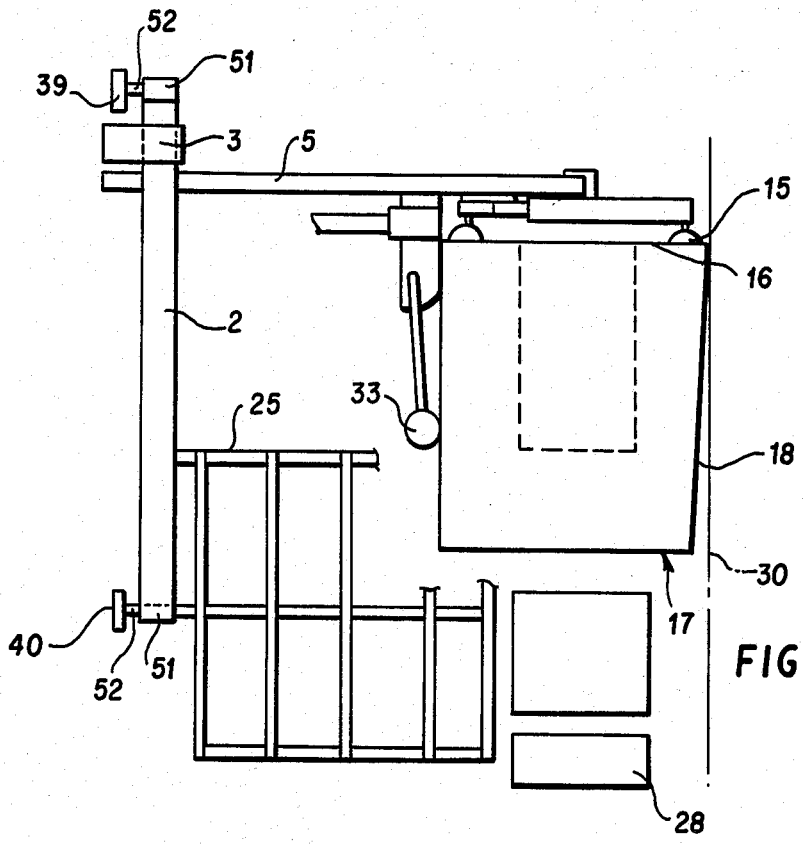
Figure 3A:
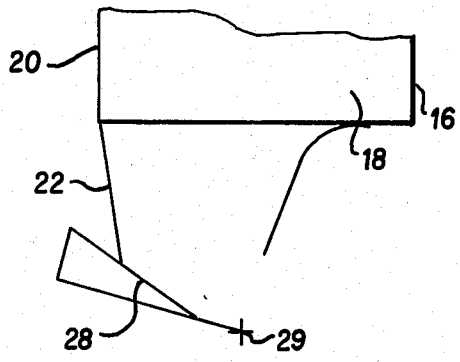

Now the invention is elucidated by means of an embodiment shown in the drawing, in which:

FIG. 1 schematically shows a front view of the machine;

FIG. 2 schematically shows a top plan view;

FIG. 2A schematically shows a top plan view similar to that of FIG. 2, showing the box as erected; and FIGS. 3 3A and 3A schematically shows side views of a small part of the machine, illustrating several stages in the operation of folding the bottom flap.

For clarity sake the drawing only shows those parts of the machine which are of importance and then only schematically.

The machine comprises a frame 1 from which only some parts are indicated. The frame 1 comprises a guiding rod 2 over which a sleeve 3 is movable to and fro in the direction of the arrow P.

From the sleeve 3 a leg 4 is extending downwardly to which an arm 5 is pivotably mounted, such that the arm 5 can rotate around point 6 in the direction of the arrow R.

The arm 5 comprises a horizontal portion 7 and a vertical portion 8 to which last portion a first sleeve 9 is fixed and a second sleeve 10 is shiftably and fixable mounted.

The sleeve 9 carries a leg 11, which is adjustable and fixable in longitudinal direction is respect of the sleeve, a leg 12 being adjustable and fixable in the leg 11. In a corresponding way the sleeve 10 is carrying legs 13 and 14. By virtue of this arrangement, suction cups 15 connected to the legs 11–14 can be adjusted at the desired place to wit such that they are closely positioned near the corners of the leading wall 16 of a flattened box 17 which has to be erected, said box in FIG. 1 only being indicated by dash lines.

The box further comprises the side wall 18, which is substantially lying in one plane with the leading wall 16 in the starting position of the box, the side wall 19, the end wall 20, the bottom flap 21 connected to the leading wall 16, the bottom flap 22 connected to the end wall 20 and the bottom flaps 23 connected to the side walls 18 and 19. All these flaps are connected to the related walls by means of folding lines.

Figure 3B:
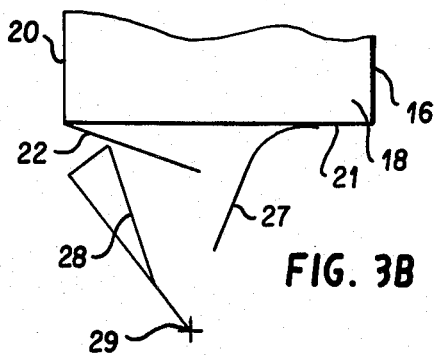

The folded boxes are placed on the supporting element 25, which is adjustable in height in respect of the frame 1 such that the folding line 24 substantially will be at the same height as the bottom support plate 26, which at the front side is provided with an oblique portion 27. During the movement of the box the portion 27 causes folding of the bottom flap 21, connected to the leading wall 16, upwardly. When the bottom flap 22 has passed a given point it will be folded upwardly by a triangular lever 28 which is rotatable about a pivot point 29 such that it will move as well over the plate 26. This is illustrated in FIGS. 3, 3A and 3B.

Thereupon the bottom side flaps 23 will be brought upwardly by two rods, not shown, which in the direction of movement of the box are running obliquely upwardly nad towards each other to a point positioned just below the box an in the middle of it.

During the erecting of the box the edge lying the most at the right in FIG. 2 is moving along a vertical support plate 30, being adjustably fixed to the frame 1. The other side edge is held up temporary by an abutment 31 of a support plate 32, which also is adjustably fixed to the frame 1. The side wall 18 then will go to swing in respect of the leading wall 16. To support this swinging movement a roller 33 is rotatably mounted to the carrying arm 34, which about a pivot point 35 is rotatably connected to a guiding 36 which is again adjustable mounted to the frame 1.

The carrying arm 34 is biassed by a spring 37 to the end position as shown in FIG. 2. When the side wall 18 of the box is engaging the roller 33 the roller together with the arm can move to the left in the direction of the arrow S against the working of the spring 37. By this a very gradually unfolding is obtained from the side walls 18 and 19 in respect of the leading wall 16 and the end wall 20. In the end position of the side walls these are moving along the guide 36.

The movement of the arm 5, provided with suction cups 15, along the guiding rod 2 takes place owing to the sleeve 3 being connected to an endless chain 38 running over the chain wheels 39 and 40 one of which can be driven.

After the suction cups 15 are being brought against a box which has to be erected they are energized by being connected to a vacuum source by means of a conduit, not shown. After movement of the arm 5 and erecting the box completely the vacuum in the suction cups is removed and air can flow into them so that they will give free the box. The fully erected box is shown in FIG. 2A.

Now an air motor 41 is activated which will swing the arm 5 in the direction of the arrow R around its fulcrum 6. When after the swinging movement the lowest suction cup is outside the track of the erected box the sleeve 3 is moved back along the guiding rod 2 to the position shown in FIG. 2. Subsequently the air motor 41 is switched such that the arm 5 will take its position again as this is shown in FIG. 1. Then the machine is ready for erecting the next box.

It will be clear that in the above only a highly schematic view of the machine is described and that many modifications can be introduced without leaving the inventive scope. So the driving of the various moving parts can take place in a totally different way.

I claim:

1. A box-erecting machine, comprising:

(a) a frame with support means for receiving a stack of tubular box blanks disposed one against the other in a substantially vertical orientation;

(b) means comprising an arm provided with a plurality of suction cups for engaging a wall of the forwardmost box blank of said stack of blanks and withdrawing said wall in a forward direction so that it forms the leading wall of an erected box;

(c) a leg supporting said arm such that the arm is rotatable in a plane parallel to the plane of said leading wall of the box blank;

(d) a sleeve connected to said leg;

(e) a guide rod supporting said sleeve for non-rotatable movement in a direction perpendicular to the plane of said leading wall, said guide rod being disposed at one side of said frame, such that an edge of said box blank not forming part of the leading wall is disposed adjacent said one side of said frame;

(f) guiding means connected to said frame for preventing movement of the edge of a box blank disposed adjacent said one side of said frame during initial movement of the leading wall, for thereafter providing further unfolding of said box blank and for moving upwardly the bottom flap of the box blank connected to said leading wall;

(g) means comprising a lever, supported by said frame at a point below said stack for rotation in a plane perpendicular to said leading wall, for bringing the rear bottom flap of said box blank into the closed position thereof;

(h) a motor drive means associated with said arm for rotating said arm in said parallel plane through a predetermined angle;

(i) a motor drive means associated with said sleeve for moving said sleeve in said perpendicular direction to and fro along said guide rod; and (j) control means associated with said suction cups and said motor drive means for rotating said arm, for controlling the application of suction to said suction cups, for controlling release of said suction from said suction cups, and for switching on and off said motor drive means for rotating said arm.

2. A machine according to claim 1 wherein said arm is provided with at least four suction cups disposed in a rectangular pattern and includes adjustable mounting means arranged such that the two lowest suction cups, in the initial position thereof prior to being pressed against the leading wall of a said box blank, are disposed at the same height but are adjustable over mutually equal distances with respect to a vertical line which corresponds with the center line of the leading wall of a box to be erected, said arm further comprising a further adjustable mounting means for providing adjustment of the positions of the other two suction cups of said at least four suction cups at varying distances above the first mentioned two suction cups.

3. A machine according to claim 1 further comprising a carrier arm supported for rotation in a generally horizontal plane and oriented in a direction at right angles to the leading wall of a box blank in the support means to be erected, and a roller located at one end of said carrying arm, said machine further comprising a spring biasing said carrier arm towards a starting position, and the other end of said carrier arm being rotatably connected to a guide member for a corresponding side wall of the box to be erected such that this side wall can cause rotation of the carrier arm against the biasing force of said spring during erecting of a said box, said spring causing the carrier arm to move back to the starting position thereof after the box has passed thereby.

* * * * *